US011653719B2

(12) United States Patent
Schulten-Gaywood

(10) Patent No.: US 11,653,719 B2
(45) **Date of Patent: *May 23, 2023**

(54) EQUESTRIAN FOOTWEAR WITH INTEGRATED ADJUSTABLE SPUR SYSTEM

(71) Applicant: Nicola Veronica Schulten-Gaywood, Rockford, MI (US)

(72) Inventor: Nicola Veronica Schulten-Gaywood, Rockford, MI (US)

( * ) Notice: Subject to any disclaimer, the term of this patent is extended or adjusted under 35 U.S.C. 154(b) by 30 days.

This patent is subject to a terminal disclaimer.

(21) Appl. No.: 17/094,748

(22) Filed: Nov. 10, 2020

(65) Prior Publication Data

US 2021/0059358 A1 Mar. 4, 2021

Related U.S. Application Data

(63) Continuation-in-part of application No. 15/819,739, filed on Nov. 21, 2017, now Pat. No. 10,827,805.

(51) Int. Cl.

| | |
|---|---|
| ***A43B 5/00*** | (2022.01) |
| ***A43C 17/02*** | (2006.01) |
| ***A43C 17/04*** | (2006.01) |
| ***A41D 1/08*** | (2018.01) |
| ***A43B 3/00*** | (2022.01) |
| ***A43C 11/12*** | (2006.01) |

(52) U.S. Cl.

CPC ..... *A43C 17/02* (2013.01); *A43B 3/0031* (2013.01); *A43B 5/006* (2013.01); *A43C 11/12* (2013.01); *A43C 17/04* (2013.01)

(58) Field of Classification Search

CPC ..... A43B 5/006; A41D 1/086; A43C 17/00; A43C 17/02; A43C 17/04; A43C 17/06

USPC ..... 36/74, 131, 1.5, 2 R, 2 A, 2 B

See application file for complete search history.

(56) References Cited

U.S. PATENT DOCUMENTS

| | | | | |
|---|---|---|---|---|
| 740,226 A * | 9/1903 | Brown | A43C 17/00 | 36/2 R |
| 3,296,667 A * | 1/1967 | Streule | A43C 11/14 | 24/578.13 |
| 3,654,670 A * | 4/1972 | Baso | A43C 11/1413 | 24/70 SK |
| 6,205,686 B1 * | 3/2001 | Davis | A43C 17/04 | 36/138 |
| 6,360,456 B2 * | 3/2002 | Davis | A43B 11/00 | 36/138 |

(Continued)

FOREIGN PATENT DOCUMENTS

FR 3025701 A1 * 3/2016 ..... A43C 17/02

*Primary Examiner* — Sharon M Prange

(74) *Attorney, Agent, or Firm* — Frank M. Scutch, III

(57) ABSTRACT

A lower body equestrian riding boot system for holding a riding spur includes a boot having one or more pockets located on an outer surface of a side and near one end of the boot, the pocket is configured to retain a free end of a riding spur yoke. A backstrap located on an outer surface of a back side and near the bottom of the boot has one end that is releasably attached to the boot and includes an aperture through which a neck of a riding spur projects. A concealed curved zipper extending beyond the front of a pocket. The pocket, the backstrap and the zipper cooperate to secure the riding spur to the boot, so that the spur can be easily attached, adjusted and/or removed from the boot, and so the boot can be removed from the foot with the spur still attached.

16 Claims, 7 Drawing Sheets

(56) References Cited

U.S. PATENT DOCUMENTS

| | | | | |
|---|---|---|---|---|
| 6,536,196 | B2 * | 3/2003 | Harrison | A43C 17/02 54/83.2 |
| D579,648 | S * | 11/2008 | McDowell | A41D 17/02 D2/970 |
| 7,836,524 | B2 * | 11/2010 | Muench | A41D 17/02 2/232 |
| 7,913,427 | B2 * | 3/2011 | Edwards | A43C 17/02 54/83.2 |
| 9,021,721 | B2 * | 5/2015 | McCarron | A43B 21/26 36/28 |
| 10,251,441 | B2 * | 4/2019 | Benetti | A43B 5/006 |
| 2009/0083997 | A1 * | 4/2009 | Edwards | A43B 5/006 36/74 |
| 2015/0096201 | A1 * | 4/2015 | Marcon | A43B 23/06 36/109 |
| 2020/0037703 | A1 * | 2/2020 | Twist | A43C 11/1493 |

* cited by examiner

EQUESTRIAN FOOTWEAR WITH INTEGRATED ADJUSTABLE SPUR SYSTEM

CROSS-REFERENCE TO RELATED APPLICATION

This application is related to U.S. application Ser. No. 17/094,756 entitled EQUESTRIAN HALF SPUR FOR USE WITH AN ADJUSTABLE SPUR HOLDER, owned by Nicola Veronica Schulten-Gaywood which is filed concurrently herewith and is herein incorporated by reference in its entirety.

FIELD OF THE INVENTION

The present invention is direct to an improved method and apparatus for attaching a riding spur to equestrian footwear, such as a boot, wherein the spur can be quickly and easily attached, adjusted or removed without dismounting the horse, and additionally provides the user with improved comfort and freedom of movement throughout equestrian activity.

BACKGROUND OF THE INVENTION

People have been using spurs while riding horses for many years. A spur is a device which is worn on the back of a rider's boot, on or just above the heel, and helps the rider direct a horse's movement in various ways. Some specialized spurs are permanently fixed to the boot, but most spurs are temporarily secured with a strap. The main part of a conventional spur is a rigid U-shaped bracket, called a yoke, which wraps around the back-heel area of a riding boot. A rigid protrusion, called a spur neck, is fixed to and extends backward from the center of the rear, curved portion of the yoke. The distal end of the spur neck is called a spur tip, which is the part of the spur that physically contacts the horse. Most spurs are held in place by an instep strap, which is connected to both forward, free ends of the yoke and wraps over the instep and under the sole of a boot. The instep strap holds the front part of the spur yoke in place.

The rear part of the spur yoke is held in place and supported by a spur rest, which is a small lateral protuberance that extends backward from just above the heel of a riding boot. The function of the spur rest is very important, as it is intended to maintain the spur neck and spur tip in a specific position relative to the horse's anatomy. However, a common problem with this traditional method of spur attachment is the likelihood of the strap loosening during equestrian activity, which causes the rear portion of the yoke to slip down over the spur rest and drop downward, which is known as a "dropped spur".

When a spur neck shifts upward or downward from its correct position, the point of contact between the spur tip and the horse changes—or is eliminated altogether. This diminishes the rider's control of the animal, creating a potentially dangerous situation. Because precise placement of the spur tip against the horse's side is critical, the rider must then halt the horse, dismount and re-adjust the spur and re-tighten the strap, which is inconvenient and time-consuming. Furthermore, because the strap must be very tight to prevent the spur from shifting, the rider experiences severe discomfort on the instep of her/his foot.

Another disadvantage when utilizing a spur rest is that only one spur position is available, forcing the rider to spend quite a bit of time adjusting the length of the stirrup straps to an exact needed length. This being an undesirable situation, it would be advantageous to have a connective arrangement wherein the spur could be secured to a rider's foot more conveniently, and in a way that would prevent the spur from shifting. Also, because short and tall riders have different leg lengths, it would be beneficial if the spur neck could be easily lifted or lowered, so as to optimize vertical placement of the spur tip against the horse's body.

In the case of the equestrian riding boot, zippers are mostly placed in a vertical position close to the center back of the boot. In this position, specifically at the ankle, the zipper is under a lot of tension combined with flexion and abrasion because of the rider walking around when unmounted. This causes the integrity and strength of the zippers to diminish, and as a result break down, and no longer perform their function of keeping the boot closed at the ankle. Zippers are mostly covered with two narrow flaps extending from each side of the zipper. The narrow flaps, combined with the flexion, and tension experienced in the ankle area are not sufficient in size and structure to maintain coverage, and protection of, the zipper structure, leaving the area exposed to sand and fine debris. The addition of debris to the zipper structure along with the tension, flexion, and abrasion in the ankle area, leave the zipper even more at risk of failure. Furthermore, should the rider wish to remove the boot, they will need to undo, loosen, and release the instep strap, to remove the spur assembly, at which point the rider can remove the boot. The boot and the spur assembly are separated and will need to be reconfigured when the rider replaces the boot on the foot.

FIG. 1 to FIG. 8 illustrate various embodiments known in the prior art. More specifically, FIG. 1 shows a traditional spur assembly 8, comprised of a yoke 10 having two free ends 9 which are connected by an instep strap 11. The yoke 10 also includes a spur neck 12 and a spur tip 14.

FIG. 2 shows a leg of a mounted rider wearing a traditional riding chap 7 and a traditional riding boot 6, wherein the leg is supported by a stirrup 17. The chap 7 is held in place by a footstrap 18, which passes under the sole of boot 6 and connects to opposite lower ends of the chap 7. The rider is also wearing the traditional spur assembly 8 shown in FIG. 1, wherein the yoke 10 is secured to boot 6 by instep strap 11, which is connected to the free ends 9 of yoke 10. Note how the rear portion of yoke 10 and the spur neck 12 are supported by a spur rest 13, which projects off the back of boot 6. The spur tip 14 is shown in physical contact with the lower side of a horse.

FIG. 3 shows the same image shown in FIG. 2, including the stirrup 17, chap 7, footstrap 18, boot 6, and traditional spur assembly 8, which is comprised of an instep strap 11, a yoke 10 with free ends 9, a spur neck 12 and spur tip 14. Note that the rear portion of yoke 10 has fallen off the spur rest 13, and as a result, the spur neck 12 and spur tip 14 are no longer in contact with the side of the horse.

FIG. 4 shows a model wearing traditional riding chaps 7, which are secured to traditional riding boots 6 by footstraps 18. Each boot includes a spur rest 13, located above the heel.

FIG. 5 shows a model wearing traditional full-length riding chaps 15, which are secured to traditional riding boots 6 by footstraps 18. Each boot includes a spur rest 13, located above the heel.

FIG. 6 shows a model wearing traditional riding boots 6. Each boot includes a spur rest 13, located above the heel.

FIG. 6A is a perspective view of a traditional riding boot with a traditional spur assembly as seen in FIG. 1. A traditional riding boot 6, with the traditional spur assembly 8 where the yoke 10 is secured to a boot 6, by an instep strap 11 the inset strap is connected to a free end, 9, of the yoke, 10. The spur tip 14 is shown having fallen off the spur rests 13 which are located on each side of the heel. A zipper 38 is positioned in a center back position with two narrow flaps 39 covering each side of the zipper 38. The damaged zipper 40, and puckered open zipper flap covers 41, are shown in the ankle area of the boot 6 demonstrating failure of the narrow zipper covers 39, to protect the zipper 38, from debris entering and causing damage. Furthermore, the drawing demonstrates that in order to remove the boot 6, the rider must first remove the spur assembly 8, by way of dismounting and undoing/unfastening the instep strap 11 and removing the yoke, before unzipping the zipper 38 and removing the boot 6.

FIG. 7 shows the traditional spur yoke 10 shown in FIG. 1, without the instep strap 11 according to an embodiment of the invention.

FIG. 8 shows the traditional spur yoke 10 shown in FIG. 7, having a roller spur tip 23.

Thus, there is a need for a new convenient, easy, improved method of securely attaching a riding spur to equestrian footwear without using an instep strap, wherein the vertical position of the spur tip can be quickly and easily changed, and without the need for removing the spur in order to remove the footwear.

SUMMARY OF THE INVENTION

The invention satisfies the need for an improved method of securely attaching a riding spur to footwear without using an instep strap, wherein the vertical position of the spur tip can be quickly and easily changed, and without having to remove the spur in order to remove the footwear. Additionally, the spur can be quickly and easily attached, adjusted or removed by a rider without having to dismount the horse. Elimination of a tightened instep strap also provides more comfort to the rider. Furthermore, the improved method of attachment described herein allows riders to use existing, traditional spur yokes on the market today, without the instep strap.

In an aspect of the invention, both free ends of the spur yoke are inserted into two rearward-facing pockets, located on the left and right side of a riding footwear, wherein the pockets firmly hold and secure the free ends of the yoke to the footwear. An optional design provides two or more pockets on one or both sides of the footwear, arranged vertically at different heights, such that a free end of the yoke can be inserted into either an upper or lower pocket in order to achieve a proper fit. Many riding boots include a full-length vertical zipper, requiring the user to disconnect the instep strap and remove the spur assembly from the footwear before able to remove their footwear. In another aspect of the invention, by providing only one side pocket, another convenient advantage can be realized: the legwear garment can be removed from the wearer without having to remove the spur, which is accomplished by using a spur yoke wherein one of the free ends is shortened, and is not inserted into a pocket.

In this arrangement, the shorter of the two free ends does not cover the vertical zipper, allowing the zipper to be completely unzipped so that the footwear can be removed. Instead of a pocket, a releasable fastener such as a snap may be used to secure a free end of the yoke to the left &/or right side of a boot. The snap may also include a strap that can be woven through a free end of a traditional yoke. Also, two or more fasteners may be located at different heights on one or both sides, to secure the free ends of the yoke at different vertical positions.

The spur neck is held in place by a vertically positioned strap called a backstrap, which is centrally located on the lower back area of the footwear. The lower end of the backstrap is attached to the footwear just above the heel where it may be permanently fixed or releasably connected via a fastener such as a snap. The backstrap includes one or more apertures through which the spur neck projects. The upper end of the backstrap is connected to the footwear using a releasable fastener such as a snap, which effectively secures the spur neck to the footwear in a desired position. By providing multiple apertures, the vertical position of a spur tip can be easily changed by using a different aperture. Furthermore, two or more apertures may be connected to each other by one or more slits, allowing a different aperture to be accessed and used by simply pushing the spur neck up or down along a slit to engage a different aperture. The position of the spur tip can also be changed by unsnapping the upper end of the backstrap, then inserting the spur neck through a different aperture. Another function of having slits between apertures is to allow bulbous spur tips to be forced through a slit in order for the spur neck to engage a desired aperture. In some instances, two or more backstraps may be used to secure a spur in various positions.

In another aspect of the invention, the zipper is located in a curved position, starting at the lower arch area of the foot on an interior or exterior side of the boot, and curving upwards at an angle facing toward the back of the boot shaft, having its end configured near the center back of the knee. This position eliminates the zipper being in an area of such great resistance, therefore making the zipper more durable and long lasting. In addition to the new location, the zipper is covered with a wide single piece of leather laying in a backward facing direction. This means the zipper is also protected from sand and fine debris clogging the zipper structure, adding to the durability, function and longevity of the zipper and boot structure. Should the rider wish to remove the boot, they would simply unzip the zipper, and remove the foot from the boot. The spur would remain integrated with the boot, by means of the back strap and pockets. The boot and spur will not need to be reconfigured when the rider replaces the boot on the foot.

These and other features, advantages and objects of the present invention will be further understood and appreciated by those skilled in the art by reference to the following specification, claims and appended drawings.

BRIEF DESCRIPTION OF THE DRAWINGS

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

NOMENCLATURE OF THE DRAWINGS

Figure 1:
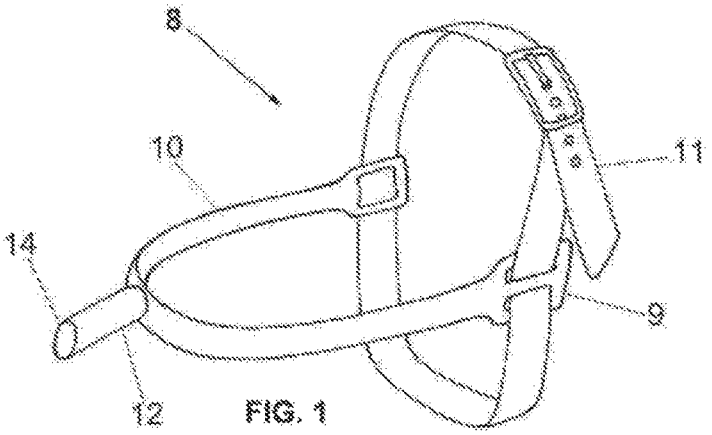
FIG. 1 (Prior art.)
FIG. 1 is a perspective view of a traditional spur assembly as used in the prior art.
Figure 2:
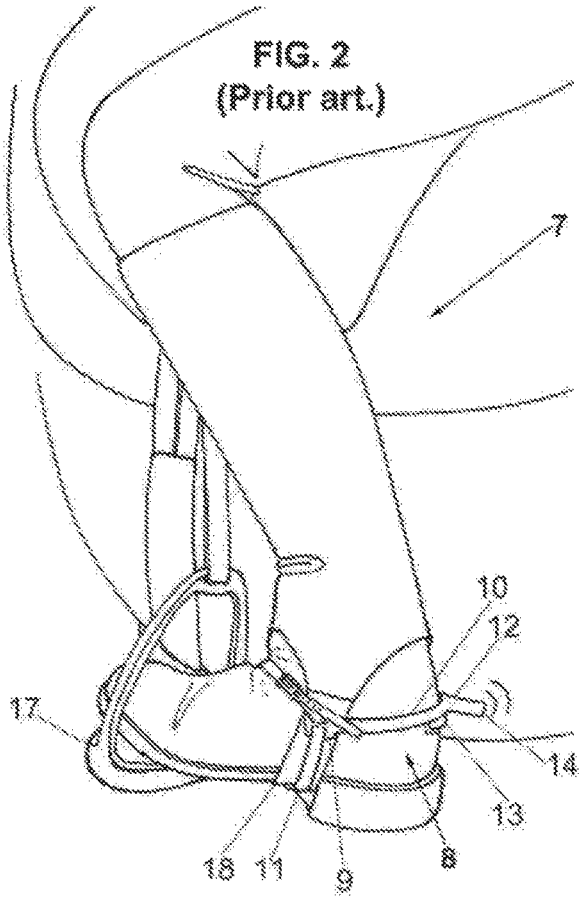
FIG. 2 (Prior art.)
FIG. 2 is a side view of a rider wearing the traditional spur assembly as shown in FIG. 1, showing the rear portion of the spur yoke being supported by the spur rest, and the spur tip in contact with the horse's side.
Figure 3:
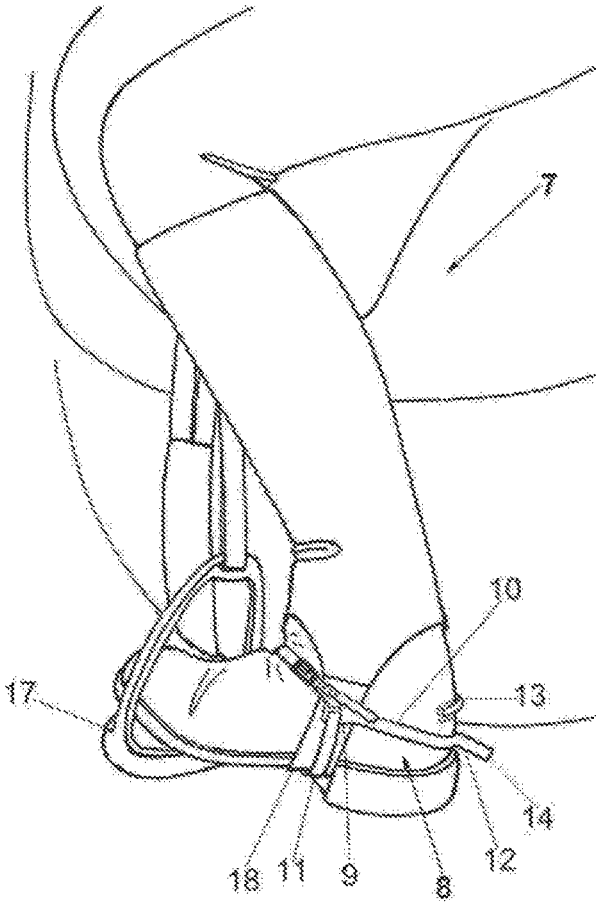
FIG. 3 (Prior art.)
FIG. 3 is a side view of a rider wearing the traditional spur assembly shown in FIG. 2, showing how the rear portion of the spur yoke has fallen off the spur rest, and the spur tip no longer in contact with the horse's side.
Figure 4:
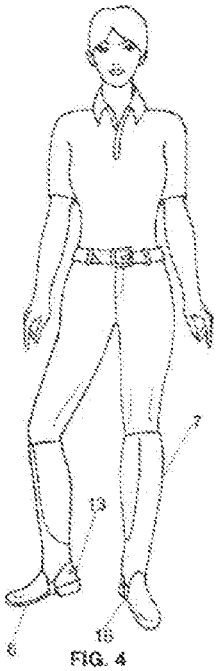
FIG. 4 (Prior art.)
FIG. 4 is a front view illustrating traditional chaps as used in the prior art.
Figure 5:
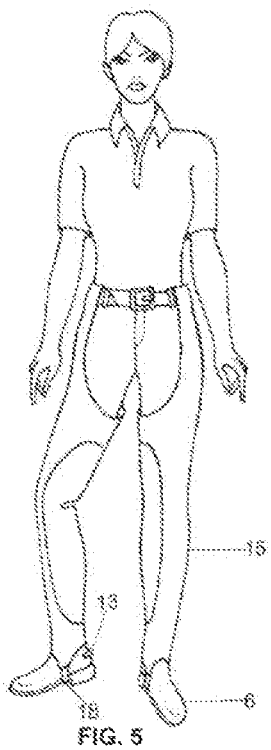
FIG. 5 (Prior art.)
FIG. 5 is a front view illustrating traditional full-length chaps as used in the prior art.
Figure 6:
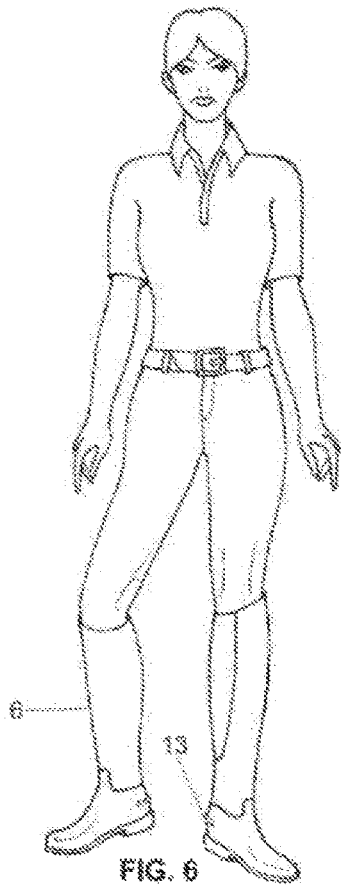
FIG. 6 (Prior art.)
FIG. 6 is a front view illustrating traditional tall riding boots as used in the prior art.
Figure 6A:
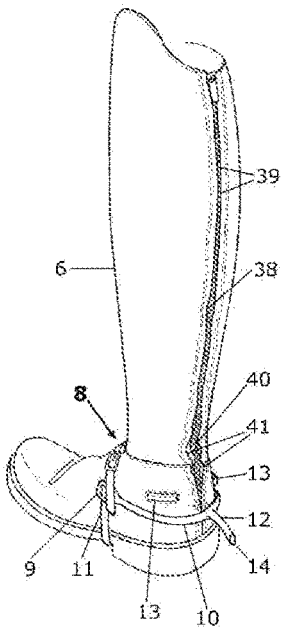
FIG. 6A (Prior art.)
FIG. 6A is illustrates a perspective view of a traditional riding boot with a traditional spur assembly and zipper configuration as used in the prior art.
Figure 7:
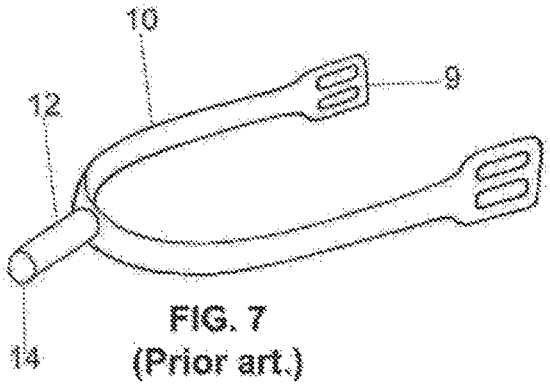
FIG. 7 (Prior art.)
FIG. 7 is a perspective view of the traditional spur yoke shown in FIG. 1, shown without the strap according to an embodiment of the invention.
Figure 8:
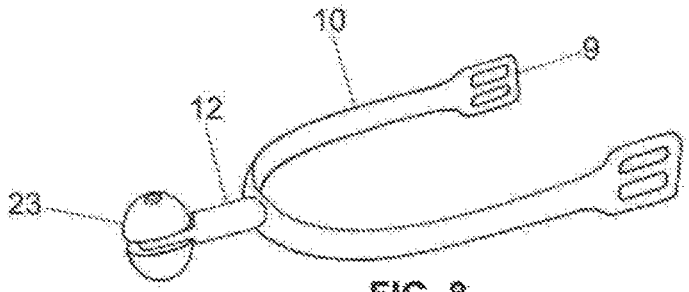
FIG. 8 (Prior art)
FIG. 8 is a perspective view of the traditional spur yoke shown in FIG. 7, having an alternative spur tip.

6—traditional riding boot
7—traditional chap
8—traditional spur assembly
9—free end of yoke
10—yoke
11—instep strap
12—spur neck
13—spur rest
14—spur tip
15—traditional full-length chap
16—chap with two pockets
17—stirrup
18—chap footstrap
19—tall riding boot with two pockets
20—backstop
21—lower snap on backstrap
22—upper snap on backstrap
23—tip of rolling spur
24—vertical zipper on chap
25—single aperture
26—lower aperture
27—center aperture
28—upper aperture
29—slit
30—opening of interior (integral) pocket
31—opening of interior (integral) pocket concealed under seam
32—opening of overlaid pocket
33—overlaid pocket
34—upper overlaid pocket
35—side strap to secure free end of yoke
36—snap on side strap
37—snap on upper flap covering zipper
38—traditional zipper in center back position
39—traditional narrow zipper flap covers
40—damaged zipper in ankle area
41—puckered, open zipper flap covers
42—concealed zipper in curved shape under protective wide cover
43—backwards facing wide cover concealing zipper
21.6—chap according to alternative embodiment
316—chap according to alternative embodiment
416—chap according to alternative embodiment
516—chap having four pockets according to an alternative embodiment
219—boot according to an embodiment of the invention
319—boot having a side strap with snap according to an alternative embodiment
419—boot having one pocket according to an alternative embodiment
519—boot according to alternative embodiment

DETAILED DESCRIPTION

Before describing in detail embodiments that are in accordance with the present invention, it should be observed that the embodiments reside primarily in combinations of method steps and apparatus components related to equestrian footwear with an adjustable spur system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 9:
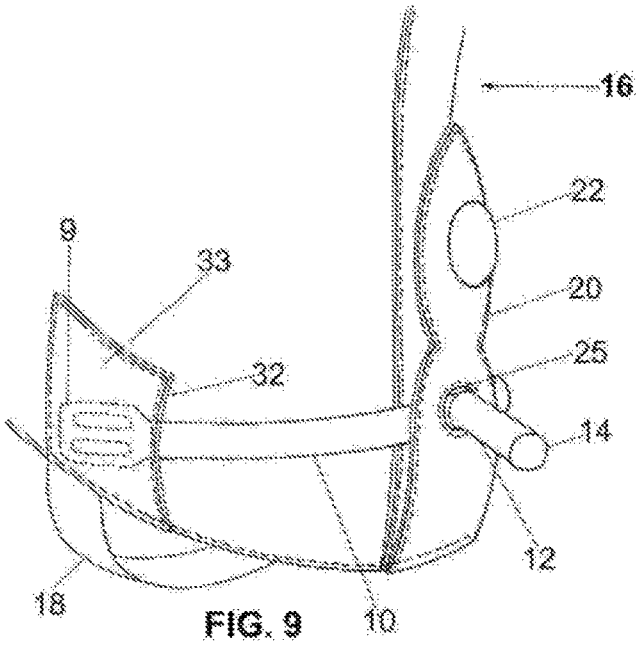
FIG. 9 is a perspective view of a chap in accordance with an alternative embodiment of the invention.

FIG. 9 illustrates a first embodiment of the invention, showing a lower back portion of an improved riding chap 16 which includes a footstrap 18. Shown in the drawing is an overlaid pocket 33 having a rearward-facing opening 32 into which a free end 9 of yoke 10 is inserted. The two side pockets 33 secure the front portion of yoke 10 to chap 16. The spur tip 14 and spur neck 12 protrude through an aperture 25 on backstrap 20, wherein the backstrap 20 supports and retains the rear portion of yoke 10. The lower end of backstrap 20 is sewn to the bottom of chap 16 and the upper end of backstrap 20 is releasably fastened to chap 16 by a snap 22, allowing yoke 10 to be quickly and easily removed.

Figure 10:
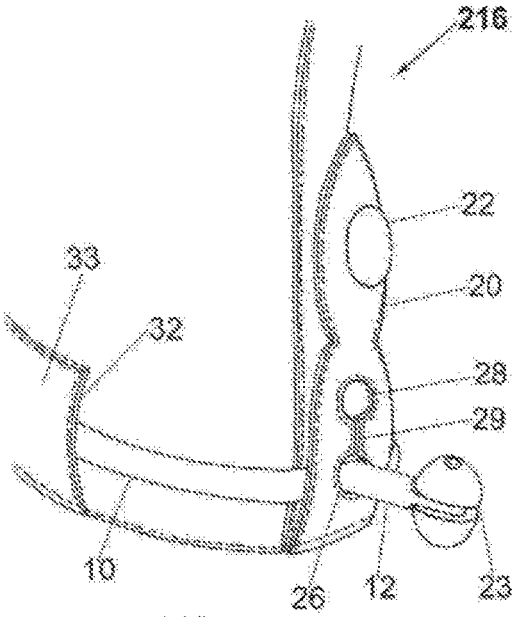
FIG. 10 is a perspective view of a chap in accordance according to still another alternative embodiment of the invention.

FIG. 10 illustrates a second embodiment of the invention, showing a lower back portion of an improved riding chap 216 which includes a footstrap 18. Overlaid pocket 33 has a rearward-facing opening 32 into which a free end 9 of yoke 10 is inserted. The two side pockets 33 secure the front portion of yoke 10 to chap 216. In this embodiment, a roller spur tip 23 is shown protruding through a lower aperture 26, which is connected to an upper aperture 28 by a slit 29, wherein the bulbous roller spur tip 23 can be forced through slit 29 and apertures 26 and 28, allowing the spur neck 12 to engage the lower aperture 26. As with all the embodiments of this invention, the backstrap 20 supports and secures the spur neck 12 and rear portion of the yoke 10, and is releasably fastened to chap 216 using a snap 22.

Figure 11:
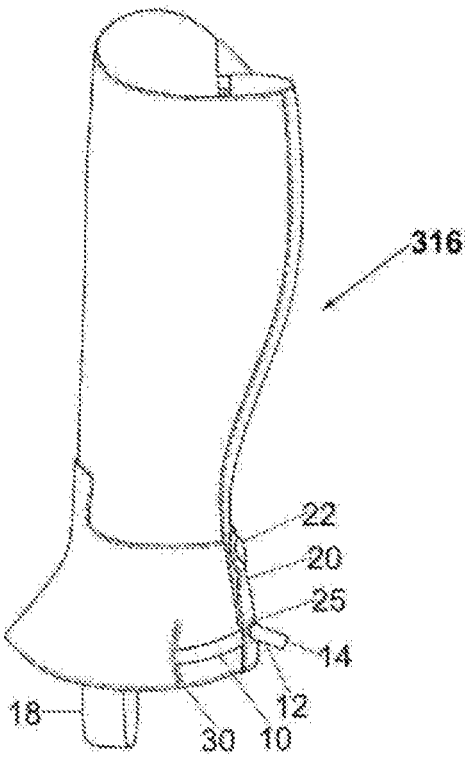
FIG. 11 is a side view of a chap in accordance with still another embodiment of the invention.

FIG. 11 illustrates a third embodiment of the invention, showing a side view of an improved riding chap 316 which includes a footstrap 18 and an opening 30 of a rearward-facing interior pocket, into which a free end 9 of yoke 10 is inserted and retained. Unlike the overlaid pocket 33 shown in FIG. 9, which is a separate piece of material that is sewn onto a large piece of material forming a side of a legwear garment, an interior pocket is integrally formed inside the aforementioned large piece of material. The backstrap 20, aperture 25, and snap 22 all cooperate to support and secure yoke 10, spur neck 12 and spur tip 14 to the chap 316.

Figure 12:
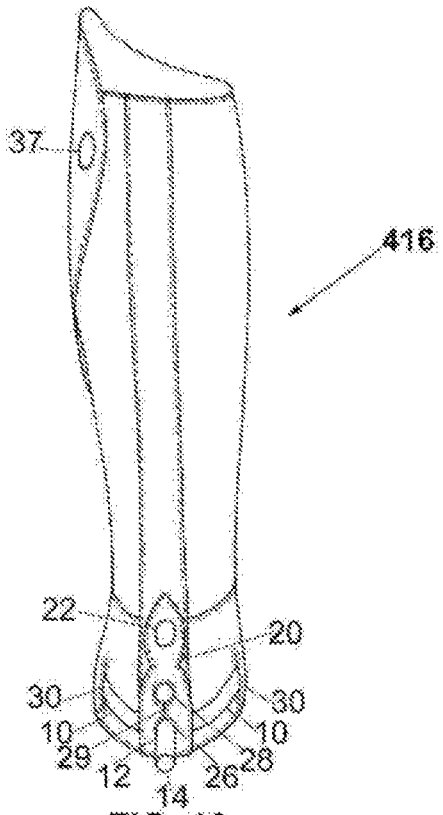
FIG. 12 is a back view of a chap in accordance with still another embodiment of the invention.

FIG. 12 illustrates a fourth embodiment of the invention, showing a back view of an improved riding chap 416, which is similar to chap 316 shown in FIG. 11, but includes a backstrap 20 having a lower aperture 26 and an upper aperture 28, which are connected by a slit 29. Also shown in the drawing are two interior pocket openings 30, a yoke 10 with a spur neck 12 and spur tip 14, and a snap 22 fixed to the upper end of backstrap 20. Shown near the top edge of chap 416 is a flap which is secured by a snap 37, which has nothing to do with this invention.

Figure 13:
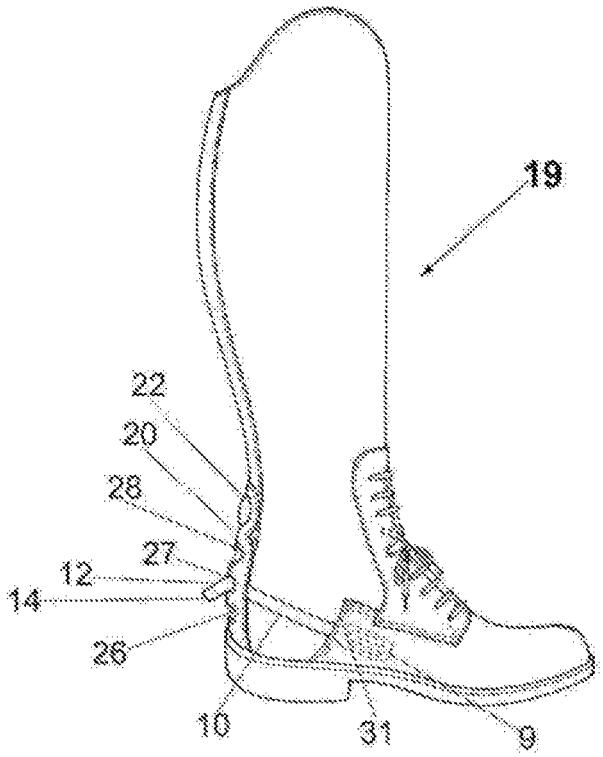
FIG. 13 is a side view of a tall riding boot in accordance with still another embodiment of the invention.

FIG. 13 illustrates a fifth embodiment of the invention, showing a side view of an improved tall riding boot 19. The location of one free end 9 of yoke 10 is shown inside an interior pocket having a rearward-facing opening 31 which is concealed under a structural seam of the boot. Attached to the back of the boot is a backstrap 20 having three apertures 26, 27, 28, and a snap 22. The spur neck 12 and spur tip 14 protrude through center aperture 27.

Figure 14:
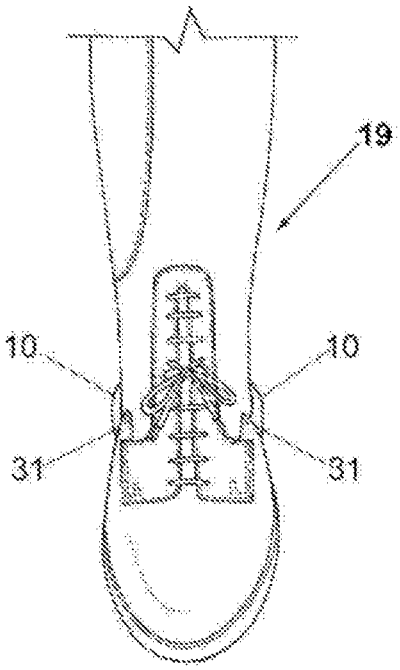
FIG. 14 is a front view of the tall riding boot shown in FIG. 13.

FIG. 14 is a front view of the improved tall riding boot 19 shown in FIG. 13, showing the yoke 10 and concealed pocket openings 31.

Figure 15:
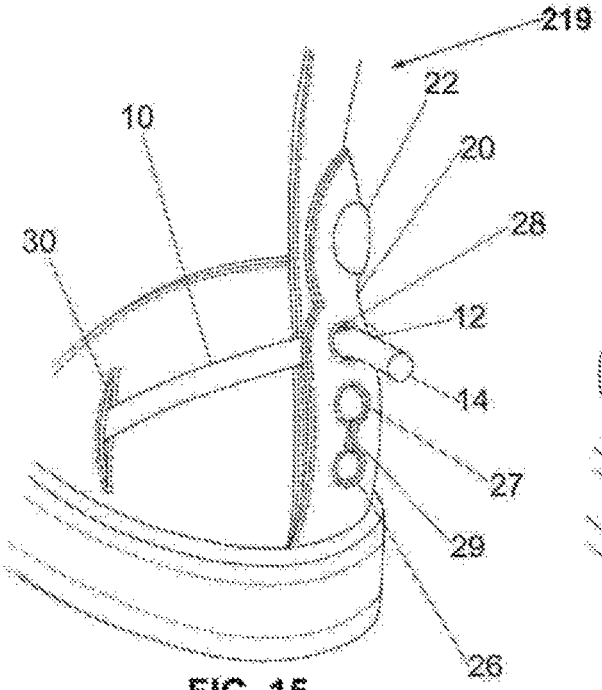
FIG. 15 is a perspective view of a boot in accordance with yet another embodiment of the invention.

FIG. 15 illustrates a sixth embodiment of the invention, showing a lower back portion of an improved riding boot 219, with a free end 9 of the yoke 10 inserted into the opening 30 of an interior pocket, which retains the front portion of yoke 10. As shown on backstrap 20, only the lower aperture 26 and center aperture 27 are connected by a slit 29. Spur neck 12 and spur tip 14 protrude through upper aperture 28 and are secured to boot 219 by snap 22.

Figure 16:
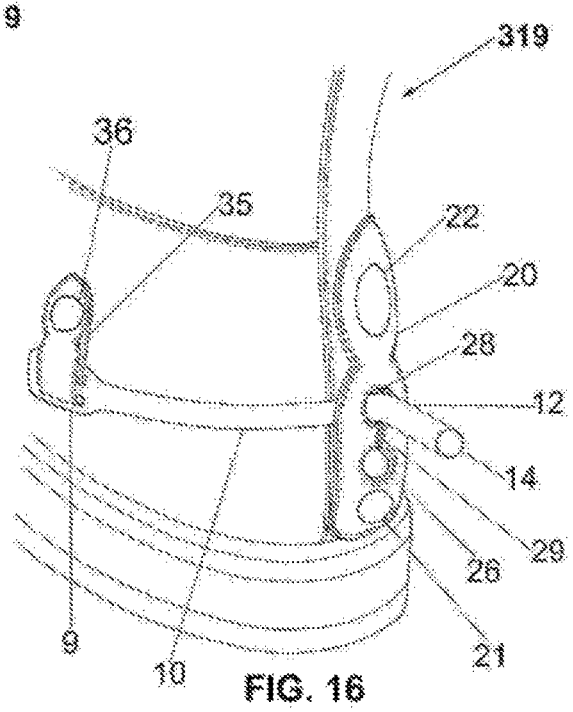
FIG. 16 is a perspective view of a boot in accordance with yet another embodiment of the invention.

FIG. 16 illustrates a seventh embodiment of the invention, showing a lower back portion of an improved riding boot 319, wherein an alternative connective arrangement is used to secure the yoke 10 to the boot 319. Instead of being inserted into a pocket, the free end 9 of yoke 10 is supported and retained by a strap 35 and fastened to the side of boot 319 by a snap 36. A backstrap 20 includes a lower aperture 26 and an upper aperture 28, which are connected by a slit 29. The backstrap 20 supports spur neck 12 and spur tip 14, and includes an upper snap 22 and also includes a lower snap 21. This method of attachment enables both the side strap 35 and backstrap 20 to be completely removed from the boot if desired.

Figure 17:
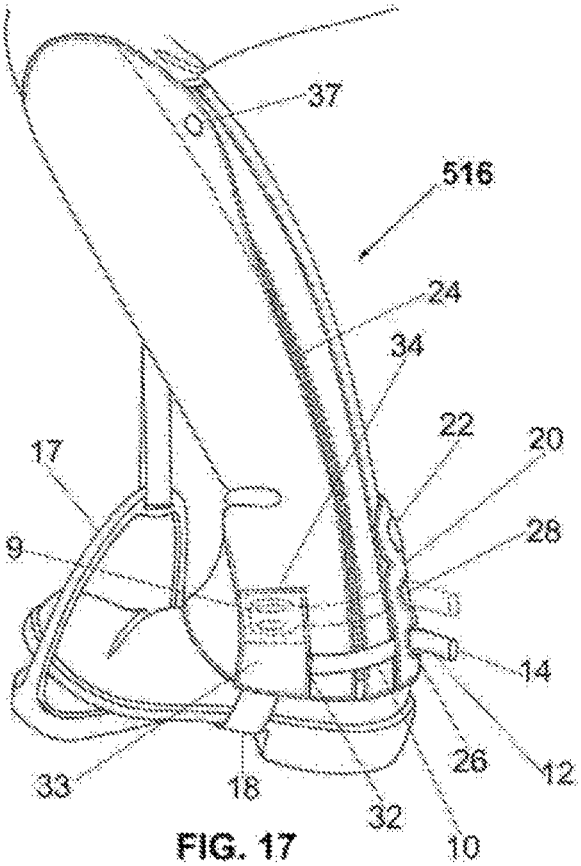
FIG. 17 is a side view of a chap in accordance with yet another embodiment of the invention.

FIG. 17 illustrates an eighth embodiment of the invention, showing a side view of a mounted rider's lower leg covered by an improved riding chap 516, with the foot being suspended by a stirrup 17. Chap 516 includes a footstrap 18 and a vertical zipper 24 which extends from the top edge to the bottom edge of chap 516. The top end of zipper 24 is covered by a flap which is fastened by a snap 37. An upper overlaid pocket 34 is also provided, into which a free end 9 of yoke 10 may be inserted, thereby providing an elevated horizontal position for yoke 10, spur neck 12 and spur tip 14. Chap 516 is shown with a free end 9 of yoke 10 inserted into the opening 32 of lower overlaid pocket 33. The backstrap 20 includes a snap 22, a lower aperture 26 and an upper aperture 28. Spur neck 12 and spur tip 14 are shown protruding through lower aperture 26.

Figure 18:
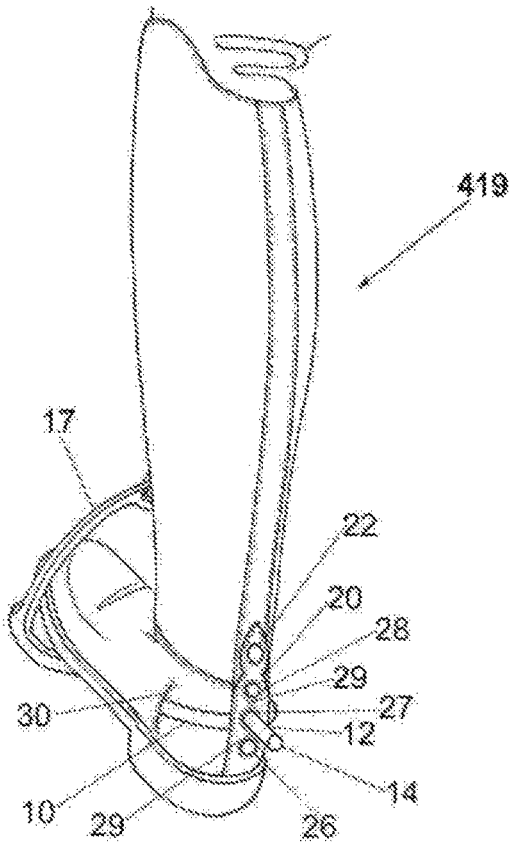
FIG. 18 is a perspective view of a tall riding boot in accordance with still another embodiment of the invention.

FIG. 18 illustrates a ninth embodiment of the invention, showing a rear perspective view of a mounted rider wearing an improved tall riding boot 419, which is supported by a stirrup 17. The backstrap 20 includes a snap 22 and three apertures 26, 27, 28, which are all connected by slits 29. The spur neck 12 and spur tip 14 are shown protruding through center aperture 27, and a free end 9 of yoke 10 is inserted into opening 30 of an interior pocket.

Figure 19:
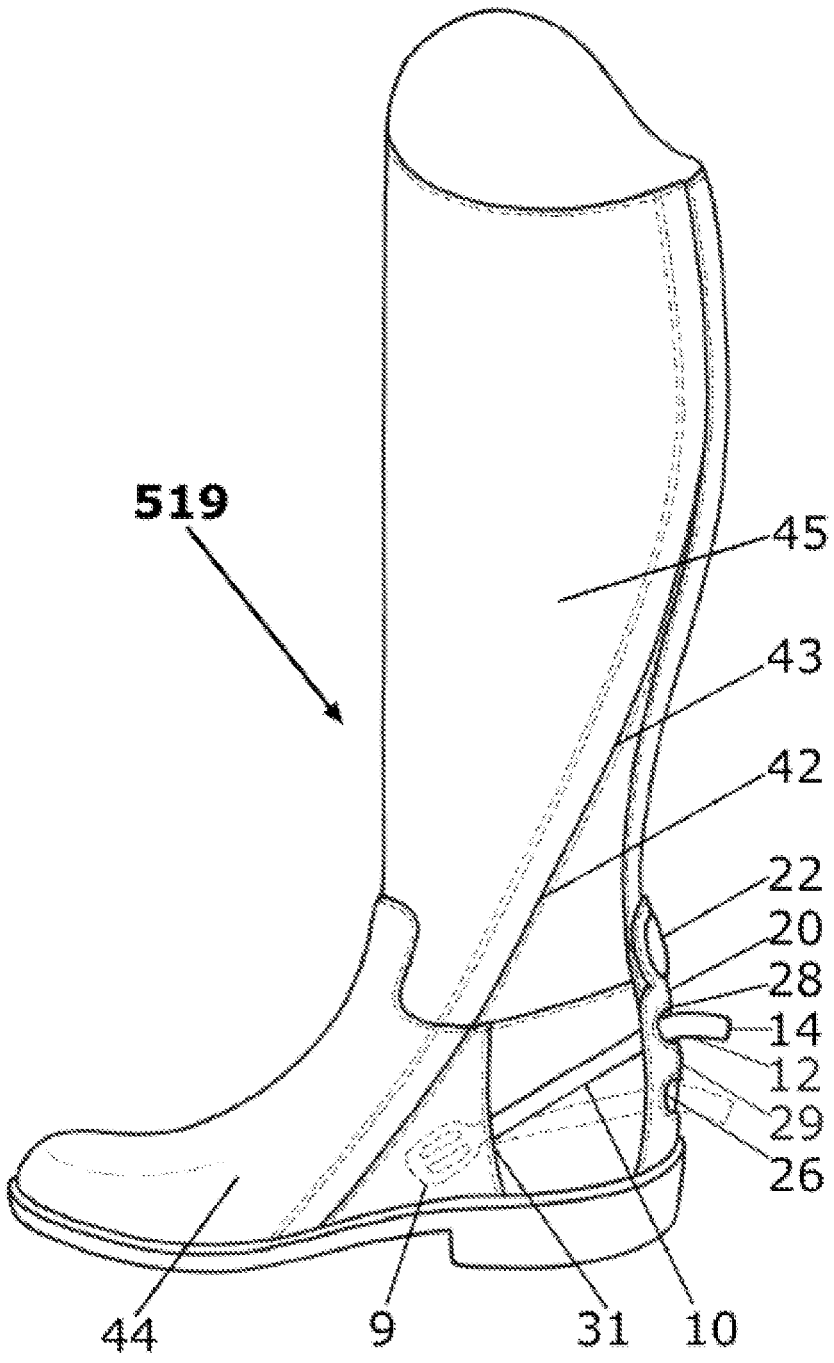
FIG. 19 is an inside view of a boot in accordance with yet another embodiment of the invention.

FIG. 19 is an inside view of a boot in accordance with an alternative embodiment of the invention. In this embodiment, the boot is an improved tall riding boot 519 that includes a back strap 20, a snap 22 and two apertures, 26, 28, which are connected by a slit 29. The spur neck 12, and spur tip, 14 are shown protruding through the upper aperture 28. A free end 9 and yoke 10 are inserted into an opening of an interior (integral) pocked concealed under a seam 31. As seen in FIG. 19, the curved zipper 42 extends from lower mid-section of the boot upper 44, beyond the end of a pocket 31, and travels in an upwardly diagonal direction towards the back of the boot, where it continues to curve upward finishing at the back of the user's knee 45.

Thus, the curved zipper 42 is positioned to extend from the lower mid-section of the boot upper 44, beyond the end of a pocket 31, travelling in an upwardly diagonal backward facing direction, around the boot shaft 45 to the upper back part of the boot, wherein the boot can be removed from the foot without removing the spur.

The curved zipper 42, is not visible to the naked eye as the zipper 42 is concealed under a backwards facing wide zipper cover 43. The wide zipper cover 43 works to protect the zipper from debris entering the zipper and its structural components. The wide zipper cover faces in a backward direction so to cover the entire curved zipper. This allows the curved zipper to be protected from debris entering the structure compromising the integrity and longevity of the component, thus shortening the useful lifespan of the boot.

The curved zipper 42 is shown in an interior, lateral, position, which avoids the flex area of the back of the ankle. Those skilled in the art will recognize that curved zipper 42 is advantageous since the zipper 42 is not subject to flexing, tension, and abrasion as used in a normal equestrian movement. Since the zipper 42 is no longer at the center-back of the boot, where it often gets puckered and fails due to the location near the user's ankle, the user can easily remove the boot without removing the spur. To remove the boot 519, the rider simply unzips the zipper, 42, and removes the foot from the boot, 519, with the spur still attached.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A lower body equestrian riding boot system for holding a riding spur, comprising:

a boot having at least one pocket located on an outer surface of at least one side and near one end of the boot, the pocket formed on a surface of the boot, the pocket being an overlaid pocket having a rearward-facing opening and being configured to retain a free end of a riding spur yoke;

a backstrap located on an outer surface of a back side and near the bottom of the boot, the backstrap having at least one end which is releasably attached to the boot and including at least one aperture through which a neck of a riding spur is configured to project, and wherein the at least one pocket and the backstrap cooperate to secure the riding spur to the boot, so that the spur can be easily attached, adjusted, or removed from the boot.

2. The lower body equestrian riding boot system of claim 1, wherein the backstrap includes one or more releasable fasteners.

3. The lower body equestrian riding boot system of claim 1, wherein the backstrap is permanently or releasably connected to the boot.

4. The lower body equestrian riding boot system of claim 1, wherein two or more apertures in the back strap are connected by one or more slits.

5. The lower body equestrian riding boot system of claim 1, wherein the spur yoke includes two free ends which are the same length.

6. The lower body equestrian riding boot system of claim 1, wherein the spur yoke includes two free ends which are not the same length.

7. The lower body equestrian riding boot system of claim 1, further comprising:

a curved zipper positioned from the lower mid-section of the boot upper, travelling in an upwardly diagonal backward facing direction, around the boot shaft to the upper back part of the boot, wherein the boot can be removed from the foot without removing the spur.

8. A boot system for holding an equestrian riding spur having a spur end and spur neck, comprising:

at least one pocket for holding a free end of a riding spur yoke;

a backstrap having a plurality of apertures through which the spur neck and spur end of a riding spur is configured to project through one of the apertures, and each of the plurality of apertures is connected to another one of the plurality of apertures by a slit in the backstrap for allowing the riding spur's position to be vertically moved to another one of the plurality of apertures;

a curved zipper extending from in front of the at least one pocket on a lower edge of the boot upper, extending around the boot shaft in a diagonal backward facing direction toward the top on the boot at the back, wherein the boot can be removed from the user with the spur attached; and wherein the backstrap is releasably detachable from the boot allowing the riding spur to be removed from the boot as required.

9. The boot stem of claim 8, wherein the backstrap includes at least one releasable fastener.

10. The boot system of claim 8, wherein the at least one pocket is configured to accommodate spur yoke ends of substantially the same length.

11. A boot system for holding an equestrian riding spur having a spur end and spur neck, comprising:

at least one pocket for holding a free end of a riding spur yoke to the boot;

a backstrap located at a bottom of the boot having at least one end which is releasably attached to the boot and a plurality of apertures connected by at least one slit through which the spur neck and spur end of a riding spur are configured to project through one of the plurality of apertures and the riding spur is vertically adjustable to another one of the apertures by moving the riding spur through one of the at least one slit; and wherein the at least one pocket and the backstrap are configured to secure the riding spur to the boot such that the spur can quickly be attached to or removed from the boot.

12. The boot system of claim 11, wherein the at least one slit is a vertical slit that is narrower in size than the aperture, where the spur neck is configured to pass though the slit for holding the neck in a fixed position in the aperture.

13. The boot of claim 11, wherein the at least one pocket is configured to accommodate spur yoke ends of substantially the same length.

14. The boot of claim 11, wherein the at least one slit is a substantially vertical slit that is smaller in size than each one of the plurality of apertures.

15. The boot of claim 11, further comprising:

at least one zipper configured into a curve and extending from the lower mid-section of a boot upper around a boot shaft finishing at the top of the boot so to be configured behind a knee, wherein the user can leave the spur in the boot when it is removed.

16. The boot of claim 15, further comprising:

a zipper cover facing in a backward direction for covering the at least one zipper to protect the at least one zipper form debris contacting its components.

* * * * *